United States Patent [19]

van Geffen

[11] 4,175,413

[45] Nov. 27, 1979

[54] METHODS AND APPARATUSES FOR FORMING BY FRICTIONAL HEAT AND PRESSURE HOLES SURROUNDED EACH BY A BOSS IN A METAL PLATE OR THE WALL OF A METAL TUBE

[75] Inventor: Johannes A. van Geffen, Apeldoorn, Netherlands

[73] Assignee: Technisch Handels- en Adviesbureau van Geffen B.V., Apeldoorn, Netherlands

[21] Appl. No.: 871,974

[22] Filed: Jan. 24, 1978

[30] Foreign Application Priority Data

Jan. 27, 1977 [NL] Netherlands ..... 7700871

[51] Int. Cl.[2] ..... B21D 28/36

[52] U.S. Cl. ..... 72/71; 408/130; 72/443

[58] Field of Search ..... 72/69, 71, 325, 443; 408/130

[56] References Cited

U.S. PATENT DOCUMENTS

| | | | |
|---|---|---|---|
| 2,991,551 | 7/1961 | Fogle et al. | 72/71 |
| 3,283,618 | 11/1966 | Schatzman | 408/130 |
| 3,336,821 | 8/1967 | Firth | 408/130 |

*Primary Examiner*—Lowell A. Larson
*Attorney, Agent, or Firm*—Snyder, Brown & Ramik

[57] ABSTRACT

A method of and an apparatus for forming by frictional heat and pressure a bossed hole in a metal plate or a tube wall with the aid of a rapidly rotating piercing tool, of which the axial feed is controlled, in such a manner, that during a predetermined time from the point of time, at which the tool comes into contact with the plate or tube wall the axial movement of the tool is slower and after that time said movement is faster than a movement of given speed.

7 Claims, 2 Drawing Figures

Figure 1:
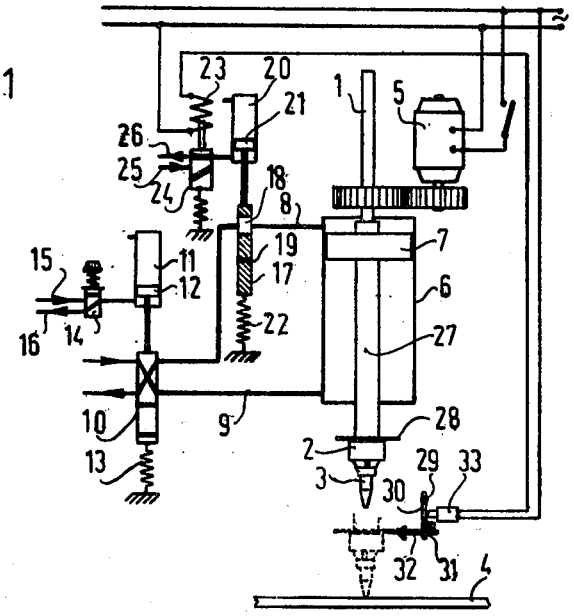

METHODS AND APPARATUSES FOR FORMING BY FRICTIONAL HEAT AND PRESSURE HOLES SURROUNDED EACH BY A BOSS IN A METAL PLATE OR THE WALL OF A METAL TUBE

The invention relates to a method of forming by frictional heat and pressure a hole of predetermined size and shape surrounded by a boss in a metal plate or the wall of a metal tube with the aid of a piercing tool rotating rapidly about its longitudinal axis and moving through said plate or tube wall, said piercing tool being coaxially attached to the rotatable spindle of a machine tool, of which the spindle is axially movable with controlled feed.

This method and a piercing tool for carrying out the method are disclosed in the French Pat. No. 1.189.384.

In order to be able to form a great number of holes per unity of time and to use the apparatus for forming the holes as efficiently as possible, one will force the piercing tool through the plate or the tube wall with a relatively great, substantially constant speed. However, in practice the problem arises that especially piercing tools of smaller diameter, say piercing tools for holes having a diameter smaller than 10 mm, often break after having formed a couple of hundred holes whereas they are only worn out after may thousands of holes.

The invention has the object to reduce the risk of breaking the piercing tools to nearly nil and this is achieved in that the axial feed of the tool is so controlled as to ensure that the tool is fed, during a determined time from at least the point of time, at which it comes into contact with the plate or the tube wall, with a speed which is lower than a given speed and after that time is fed with a speed which is higher than said given speed. It has appeared that in the point, with which the piercing tool comes first into contact with the plate or the tube wall, the friction is too slight to heat the material of the plate or the tube wall sufficiently to soften the material. The result thereof is that the centre of the hole to be formed remains solid whereas the surrounding region becomes soft. Owing thereto the piercing tool is pushed slightly out of the centre and starts to wobble about the centre. Although the wobbling and the bending of the piercing tool caused thereby are very slight, they appear to be sufficient to cause fatigue phenomena in the very hard sinter material of the tool which lead to a premature fracture. However, if, immediately after the piercing tool has come into contact with the plate or the tube wall, the speed of the feed is considerably reduced till the hard centre of the hole to be formed has acquired, by means of conduction, the high temperature of the sufficiently heated surrounding zone and thereby has become soft, the piercing tool appears not to have the tendency to bending and wobbling anymore so that it can be used till it is worn out.

As soon as the centre of the hole to be formed has become sufficiently heated, the piercing tool may be forced through the plate or the tube wall at much higher speed without any risk.

The method according to the invention may be carried out in different ways. Thus, the piercing tool may be fed with a slackened speed in the first part of its active stroke, which part is moved through with the lower axial speed. The object aimed at will also be achieved when the pressure exerted on the piercing tool is kept below a determined value at least in the first part of its active stroke, which part is moved through with the lower axial speed.

Figure 2:
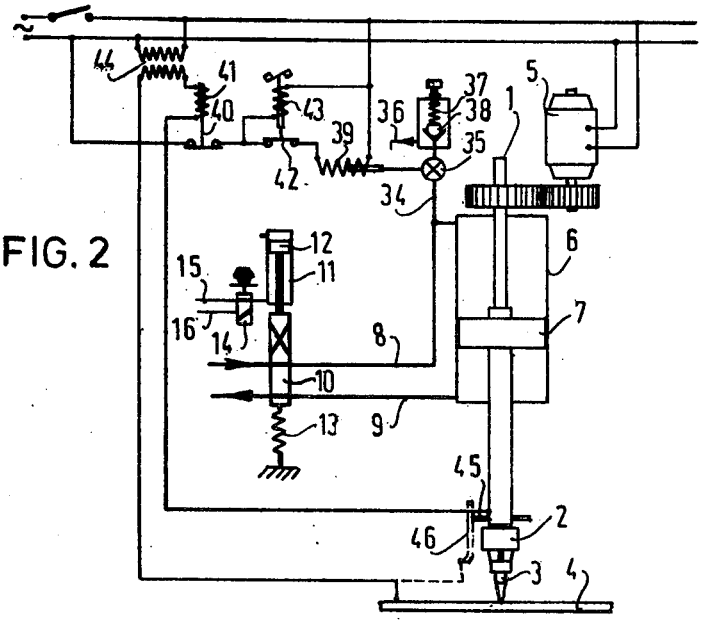

Furthermore, the invention relates to apparatuses for carrying out the mentioned methods. Two such apparatuses are illustrated in the accompanying drawing by way of example. In the drawing is:

FIG. 1 a diagrammatical presentation of a hydroelectrical machine tool with electro-pneumatic control for a rotatable piercing tool adapted to be axially moved with controllable feed and FIG. 2 a diagrammatical presentation of a variant of such a machine tool.

In FIG. 1 as well as in FIG. 2 a rotatable axially movable spindle of a machine tool is designated by 1. One end of the spindle is provided with a chuck 2, in which a piercing tool 3 for forming bossed holes in a plate 4 is fixed. The spindle is rapidly rotated about its longitudinal axis by an electromotor 5 and it is axially moved by a double acting hydraulic cylinder 6 with piston 7. The cylinder 6 is connected by fluid lines 8, 9 for a liquid to a hydraulic system which is not shown. Provided in these lines is a reversing valve 10 which is controlled by a single acting pneumatic cylinder 11 with piston 12 and by a spring 13. To control the piston 12 the cylinder 11 can be connected through a hand controlled valve 14 either with a supply line 15 for gas under pressure or with a discharge conduit 16.

The apparatus illustrated in FIG. 1 has in the line 8 for the liquid a slide valve 17 which has in one position a wide passage 18 and in the other position a very narrow passage 19, so that in the latter position of the valve 17 the supply of liquid to the cylinder 6 is choked, whereby the axial feed of the piercing tool 3 is considerably reduced. This valve is controlled by a single acting pneumatic cylinder 20 with piston 21 and by a spring 22. The active space of cylinder 20 can be connected through a conduit provided with a slide valve 24 which is controlled by an electromagnet 23 and a spring **23*a* either with a gas supply line 25 or with a gas discharge conduit 26**.

The rod 27 of the piston 7 carries for the control of the axial feed of the piercing tool a disc 28 which may be adjustably mounted. This disc is so adjusted as to slightly swing to the right an arm 30 mounted for swinging about an axis 29 and being provided with a pawl 32 adapted to be swung upwards about an axis 31 and to close thereby a switch 33, when the piercing tool 3 has approached the plate 4 closely or touches same. The disc keeps the switch closed till it has passed the pawl 32. The closing of switch 33 has the effect that the magnet coil 23 is fed, the slide valve 24 is reversed, the piston 21 is pushed upwards by the gas pressure and the slide valve 17 is positioned with its narrow passage 19 into the liquid line 8, so that the feed of the piercing tool 3 which at first was rather quick is suddenly considerably reduced. After the pawl 32 has been passed by the disc 28 the switch 33 returns to its open condition, the coil 23 becomes dead, the spring **23*a* draws the slide valve 24 back and the spring 22 pulls the slide valve 17 back into the shown position, so that the passage 18 is brought back into the line 8 and the piercing tool 3** is forced with great speed into and through the plate.

For the return movement of the piercing tool the valve 14 must be released. The result thereof is that the valve 10 returns to the shown position, so that also the piston 7 with the spindle, the piston rod 27, the chuck 2 and the piercing tool are brought back into the shown positions. During the return movement the pawl 32 is swung upwards about the axis 31 by the control disc 28, so that the switch 33 cannot be closed again. Consequently, the piercing tool is moved back quickly.

The apparatus illustrated in FIG. 2 differs from that shown in FIG. 1 in that therein it is not the axial speed of the piercing tool which is directly controlled but the pressure exerted on the tool. To this end a conduit 34 provided with a normally closed valve 35 and a pressure limiter in the form of a check valve 38 which opens towards a discharge conduit 36 and is loaded by an adjustable spring 37 is connected to line 8. The valve 35 is controlled by a magnet coil 39 and a resetting spring which is not shown. Provided in the circuit of the coil 39 is the series connection of make-contact 40 of a relay 41 and a break-contact 42 of a time lag relay 43 which may be adjustable. The current for the relay 41 is supplied by the secondary winding of a transformer 44. The piercing tool 3 and the plate 4 operate as a switch in the circuit of the relay 41.

This system operates in such a way that, if the piercing tool 3 comes into contact with the plate 4, from which the tool is at first insulated, the relay 41 closes its contact 40. This has the effect that, firstly, the magnet coil 39 is fed and the valve 35 is opened, so that the liquid pressure in the line 8 and above the piston 7 is reduced to a lower value defined by the pressure limiter 37, 38 and the feed of the piercing tool is considerably decelerated and, secondly, the time lag relay 43 is fed and opens, after an adjusted time, its contact 42. Due to the fact that the contact 42 is opened the coil 39 becomes dead, so that the valve 35 is again closed and the pressure in the cylinder space 6 above the piston returns to a considerably higher value. Thus, the piercing tool 3 is again accelerated after its retardation. As long as the piercing tool 3 is in contact with the plate 4 the relays 41 and 43 remain fed and the contact 42 stays open after its opening. Only, when during the return movement of the piercing tool the latter has lost contact with the plate 4 the electric control system returns to the starting condition, in which the contact 40 is opened and the contact 42 is closed again.

In order to prevent that the piercing tool hits the plate with a too high speed, the piston rod 27 may be provided with a contact finger 45 which, just before the piercing tool comes into contact with the plate, touches an adjustable contact strip 46. In that case the contact finger 45 and the contact strip 46 form together the switch which is necessary for the control of the feed of the piercing tool and the machine tool and the plate or the tube wall need not be electrically insulated one from the other.

What I claim is:

1. A method of forming by frictional heat and pressure a hole of predetermined size and shape surrounded by a boss in a metal plate or the wall of a metal tube with the aid of a piercing tool rotating rapidly about its longitudinal axis and moving through said plate or tube wall, said piercing tool being coaxially attached to the rotatable spindle of a machine tool, of which the spindle is axially movable with controllable feed, said method comprising the step of so controlling the axial feed of the tool as to ensure that the tool is fed, during a determined time from at least the point of time, at which it comes into contact with the plate or the tube wall, with a speed which is lower than a given speed and after that time is fed with a speed which is higher than said given speed.

2. A method as claimed in claim 1, in which the piercing tool is fed with a slackened speed during the first part of its active stroke.

3. A method as claimed in claim 1, in which the pressure exerted on the piercing tool is kept below a predetermined value at least during its slow downed movement through the first part of its active stroke.

4. In a machine tool for forming by friction-generated heat and pressure a hole of pre-determined size and shape surrounded by a boss in a metal plate or the wall of a metal tube, the combination of an axially movable rapidly rotatable spindle, a rotatable non-cutting piercing tool, the leading end of which is a point, means for the coaxial attachment of the piercing tool to an end of the spindle and means for so controlling the axial feed of the spindle and the piercing tool attached thereto, as to ensure that during its course through the plate or the tube wall the leading point of the piercing tool is moved through a first portion of said course with a speed which is lower and through the remaining portion of said course with a speed which is higher than a predetermined speed.

5. In an electro-hydraulic machine tool of the kind as claimed in claim 4 the combination of an electromotor to rotate the spindle, a hydraulic cylinder and piston assembly for the axial movement of the spindle, a hydraulic circuit connected to the cylinder spaces on both of the piston, a directional valve provided in said circuit for controlling the direction of relative movement of said piston and cylinder, means to control said directional valve, a throttling member associated with the hydraulic circuit and means for controlling the throttling member, said latter means so operating, during the active stroke of the piercing tool, as to move said member into said circuit before or at the moment of contact between the leading point of the piercing tool and the plate or the tube wall to be pierced and to remove the throttling member from the circuit immediately after the said first portion of the course of the leading point of the piercing tool through the plate or tube wall has been completed.

6. In a machine tool of the kind as claimed in claim 4 the combination of an electromotor to rotate the spindle, a hydraulic cylinder and piston assembly for the axial movement of the spindle, a hydraulic circuit connected to the cylinder spaces on both sides of the piston a directional valve provided in said circuit for controlling the direction of relative movement of said piston and cylinder, means to control said directional valve, a bypass conduit connected to the cylinder space serving the purpose of axially moving the piercing tool in its active direction, a pressure limiter provided in said bypass conduit, a stop-valve provided in the bypass conduit between the said cylinder space and the pressure limiter and means for controlling the stop-valve said latter means so operating, during the active stroke of the piercing tool, as to open the stop-valve before or at the moment of contact between the leading point of the piercing tool and the plate or the tube wall to be pierced and to close the stop-valve immediately after the said first portion of the course of the leading point of the piercing tool through the plate or tube wall has been completed.

7. In the method of piercing and forming a hole in a metal member, which comprises the steps of:

(a) providing a piercing tool having a pointed end surmounted by a tapered section; and (b) rotating said tool and feeding it axially against and through the metal member to form the hole by frictional heat and pressure, the improvement which comprises:

(c) detecting, during step (b), when said pointed end engages the metal member and limiting the pressure/feed rate of said end against the metal member to a value sufficient to prevent significant drift of said end eccentrically away from its initial point of engagement against the metal member while heat softening the metal member at the point of contact, and thereafter increasing said pressure/feed rate to form the hole substantially without eccentricity with respect to the axis of the tool.

* * * * *